US010820682B2

(12) United States Patent
Jones

(10) Patent No.: US 10,820,682 B2
(45) Date of Patent: Nov. 3, 2020

(54) FOLDING CHAIR FRAMED BACKPACK

(71) Applicant: Maurice Jones, Fairfield, CA (US)

(72) Inventor: Maurice Jones, Fairfield, CA (US)

( * ) Notice: Subject to any disclaimer, the term of this patent is extended or adjusted under 35 U.S.C. 154(b) by 0 days.

(21) Appl. No.: 16/374,134

(22) Filed: Apr. 3, 2019

(65) Prior Publication Data

US 2020/0315327 A1 Oct. 8, 2020

(51) Int. Cl.
*A45F 4/02* (2006.01)

(52) U.S. Cl.
CPC ..... *A45F 4/02* (2013.01); *A45F 2004/026* (2013.01)

(58) Field of Classification Search
CPC ..... A45F 2004/026; A47C 2009/002
See application file for complete search history.

(56) References Cited

U.S. PATENT DOCUMENTS 3,315,856 A * 4/1967 Black ..... A45F 4/02 224/155
3,889,859 A * 6/1975 Joseph ..... A45F 3/08 224/634
4,925,064 A * 5/1990 Comora ..... A45F 3/04 224/155
6,145,716 A 11/2000 Caicedo
6,345,862 B1 * 2/2002 Meinburg ..... A45F 4/02 297/118
D459,883 S 7/2002 Worrell
6,986,445 B1 1/2006 Stockman
6,997,507 B2 2/2006 Rhee
7,040,635 B1 * 5/2006 Remole ..... A47C 7/002 248/129
7,213,692 B2 5/2007 Wang
D611,680 S * 3/2010 Thomas ..... D2/829
8,191,908 B2 * 6/2012 Udall ..... B62B 5/049 280/47.26
8,303,032 B1 * 11/2012 Platta ..... A47C 4/286 297/183.5
8,573,454 B2 11/2013 Talavera
9,615,666 B2 4/2017 Milich
10,005,481 B1 * 6/2018 Lopez ..... B62B 1/12
10,028,587 B1 * 7/2018 Kersey ..... A47C 4/52
2010/0252589 A1 * 10/2010 Popescu ..... A45F 4/02 224/155
2012/0305725 A1 * 12/2012 Dackow ..... F16G 11/00 248/231.81
2015/0196110 A1 * 7/2015 Robert ..... A45F 3/08 224/633

(Continued)

FOREIGN PATENT DOCUMENTS

WO WO201611388 7/2016

*Primary Examiner* — Scott T McNurlen

(57) ABSTRACT

A folding chair framed backpack for integrating a folding chair and a backpack for outdoor sports includes a main frame and a seat frame coupled to a pair of pivoting seat attachments to have a folded position lying parallel with the main frame and an alternate seated position perpendicular with the main frame. A seat leg is pivotably coupled to the seat frame to have has a collapsed position folded adjacent the seat frame and an alternate extended position perpendicular with the seat frame in the seated position to create a chair. A plurality of seat cushions is coupled to the seat frame and the main frame. A backpack is selectively engageable with the bottom section and the rise section and a harness is coupled to the main frame.

18 Claims, 6 Drawing Sheets

(56) References Cited

U.S. PATENT DOCUMENTS

| | | | | |
|---|---|---|---|---|
| 2016/0058192 | A1* | 3/2016 | Drew | A47C 9/10<br>297/4 |
| 2017/0049218 | A1* | 2/2017 | Moncreiff | A45F 3/047 |
| 2018/0303227 | A1* | 10/2018 | Simione | A45F 3/08 |

* cited by examiner

FOLDING CHAIR FRAMED BACKPACK

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to backpacks and more particularly pertains to a new backpack for integrating a folding chair and a backpack for outdoor sports.

BRIEF SUMMARY OF THE INVENTION

An embodiment of the disclosure meets the needs presented above by generally comprising a main frame comprising a pair of curved frame posts and a plurality of cross supports extending therebetween. The main frame has a horizontal bottom section, a vertical rise section perpendicularly extending from the bottom section, and a top section extending from the rise section. Each of the frame posts has a pair of harness connection apertures. A pair of seat attachments is pivotably coupled to the rise section adjacent the top section. A seat frame is coupled to the pair of seat attachments. The seat frame has a folded position lying in a plane parallel with a plane of the rise section and an alternate seated position lying in a plane perpendicular with a plane of the rise section. At least one seat leg is pivotably coupled to a distal end of the seat frame. The seat leg has a collapsed position folded adjacent a bottom side of the seat frame and an alternate extended position lying in a plane perpendicular with the plane of the seat frame in the seated position. The seat leg in the extended position maintains the seat frame in the seated position when the main frame is resting on the ground. A plurality of seat cushions is coupled to the seat frame and the main frame. The plurality of seat cushions comprises a bottom cushion coupled to a top side of the seat frame and a top cushion coupled to the top section of the main frame. A backpack is coupled to the main frame and is selectively engageable with the bottom section and the rise section. A harness is coupled to the main frame and is selectively engageable with the pair of harness connection apertures of each of the frame posts.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
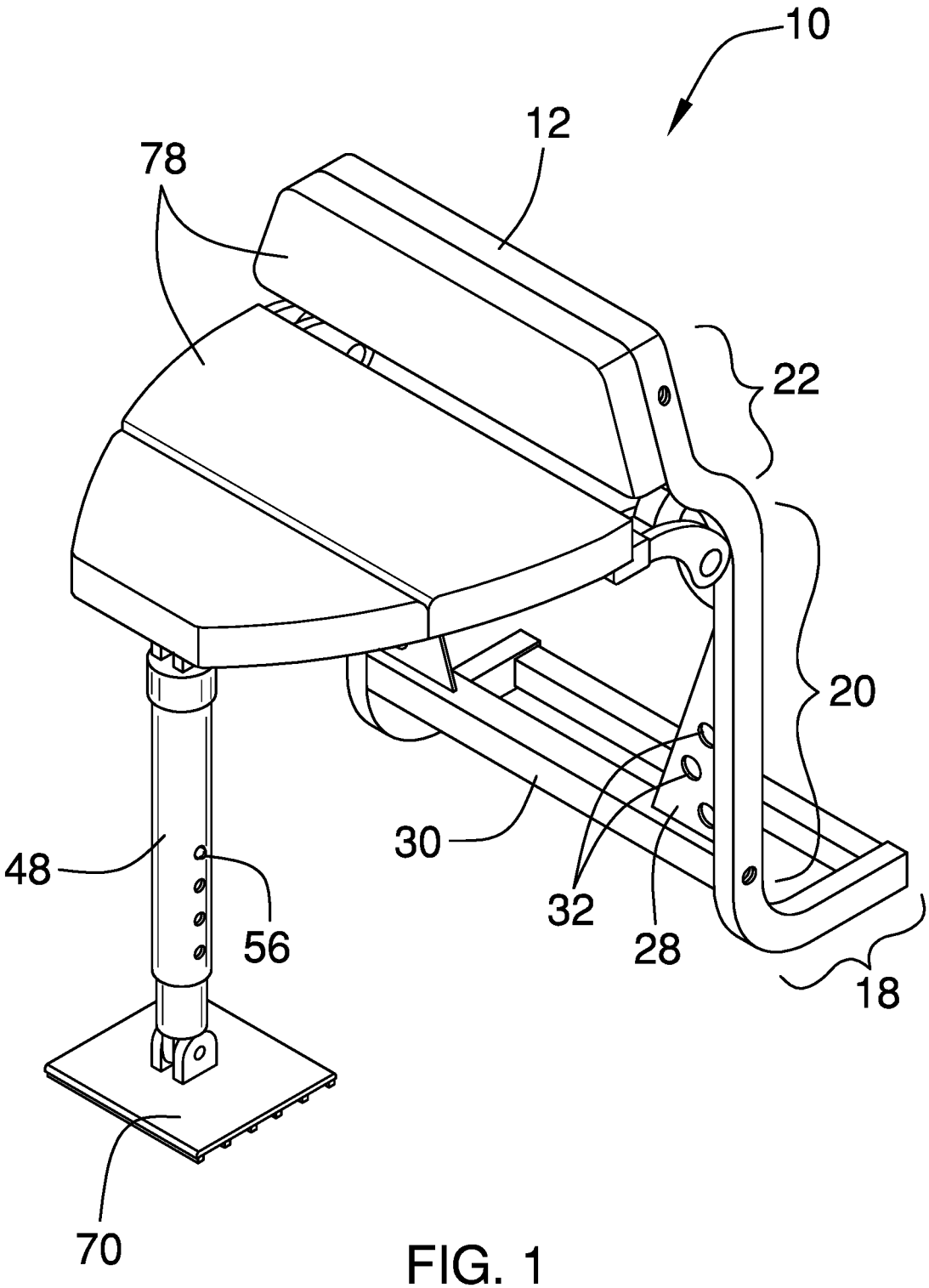
FIG. 1 is an isometric view of a folding chair framed backpack according to an embodiment of the disclosure.
Figure 2:
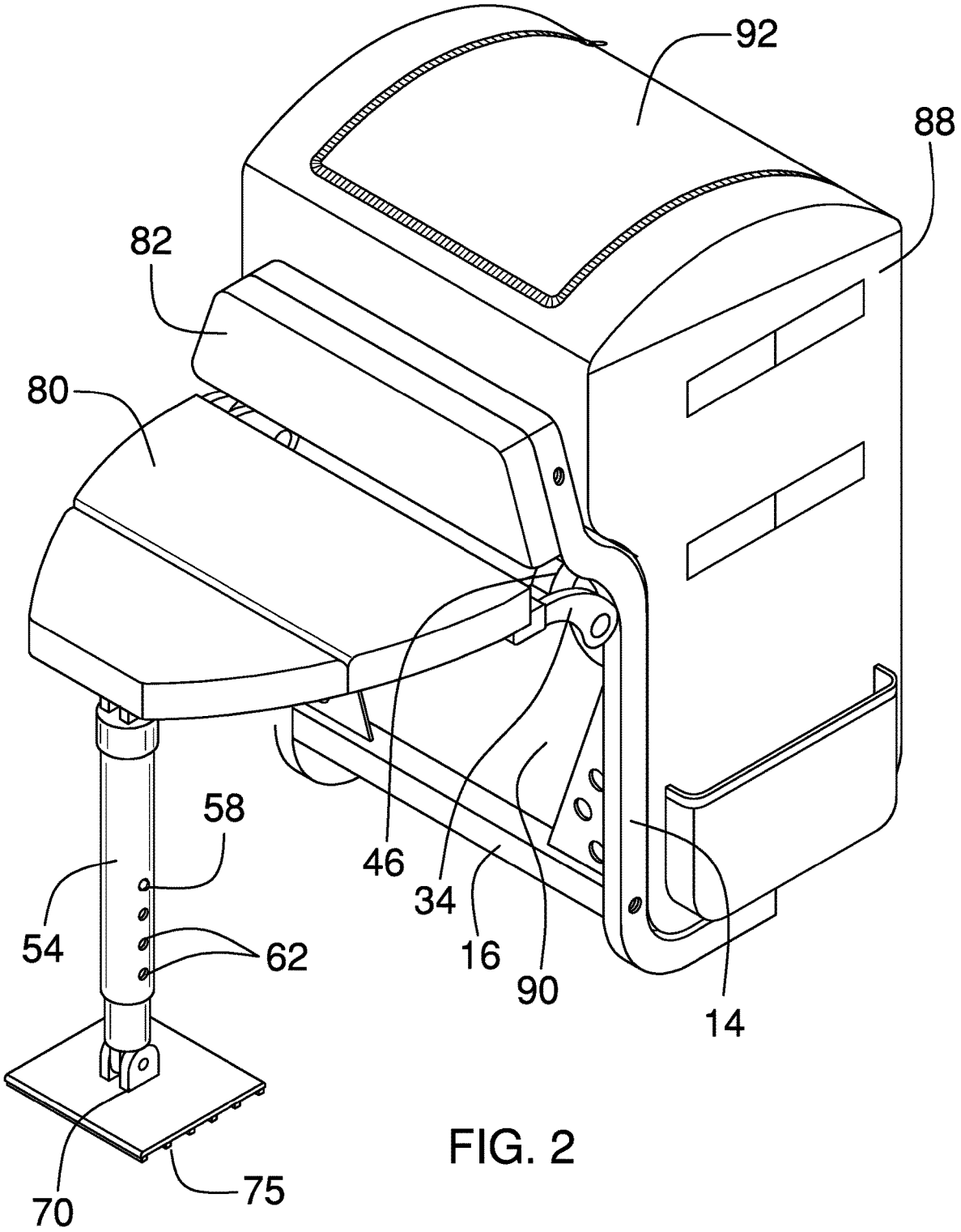
FIG. 2 is an isometric view of an embodiment of the disclosure.
Figure 3:
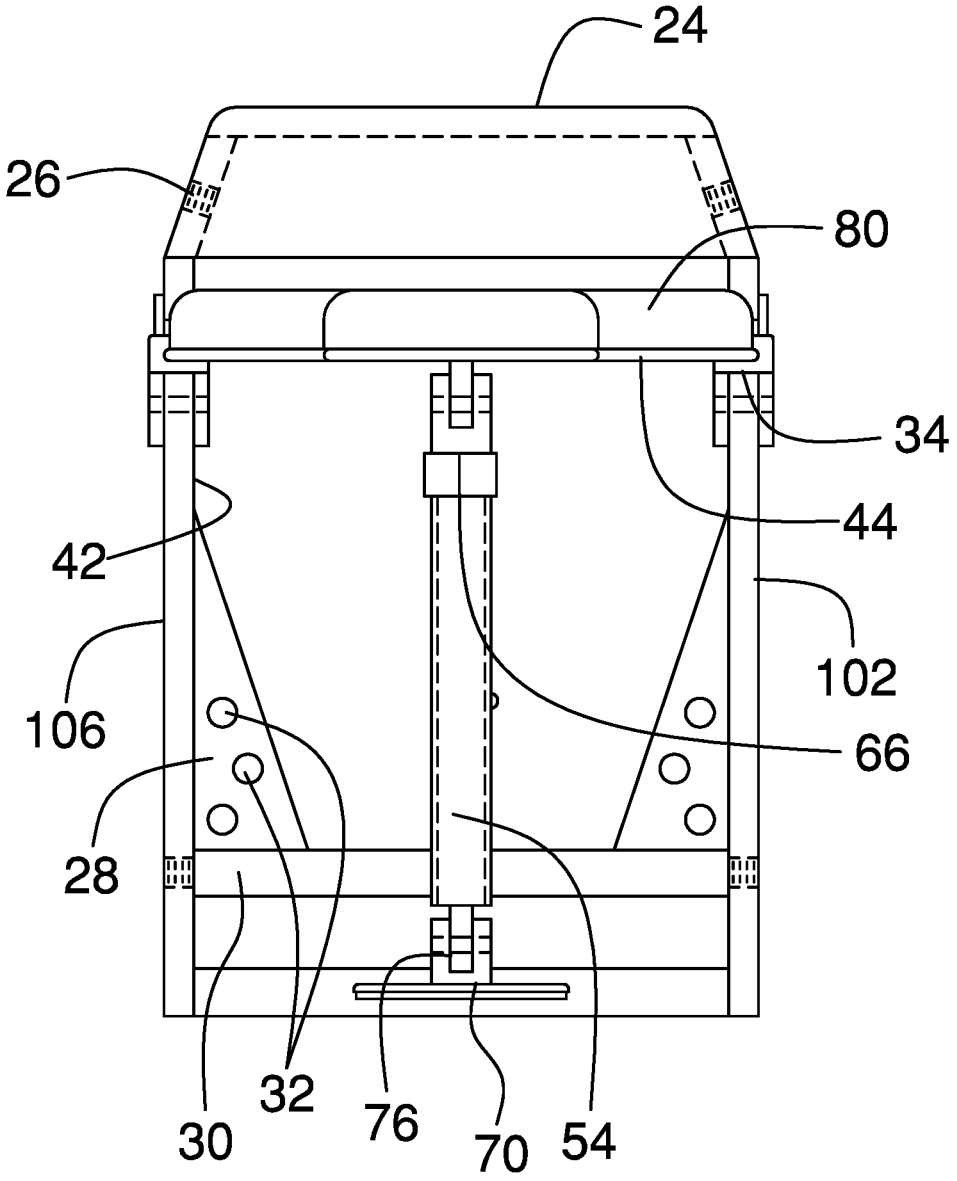
FIG. 3 is a front elevation view of an embodiment of the disclosure.
Figure 4:
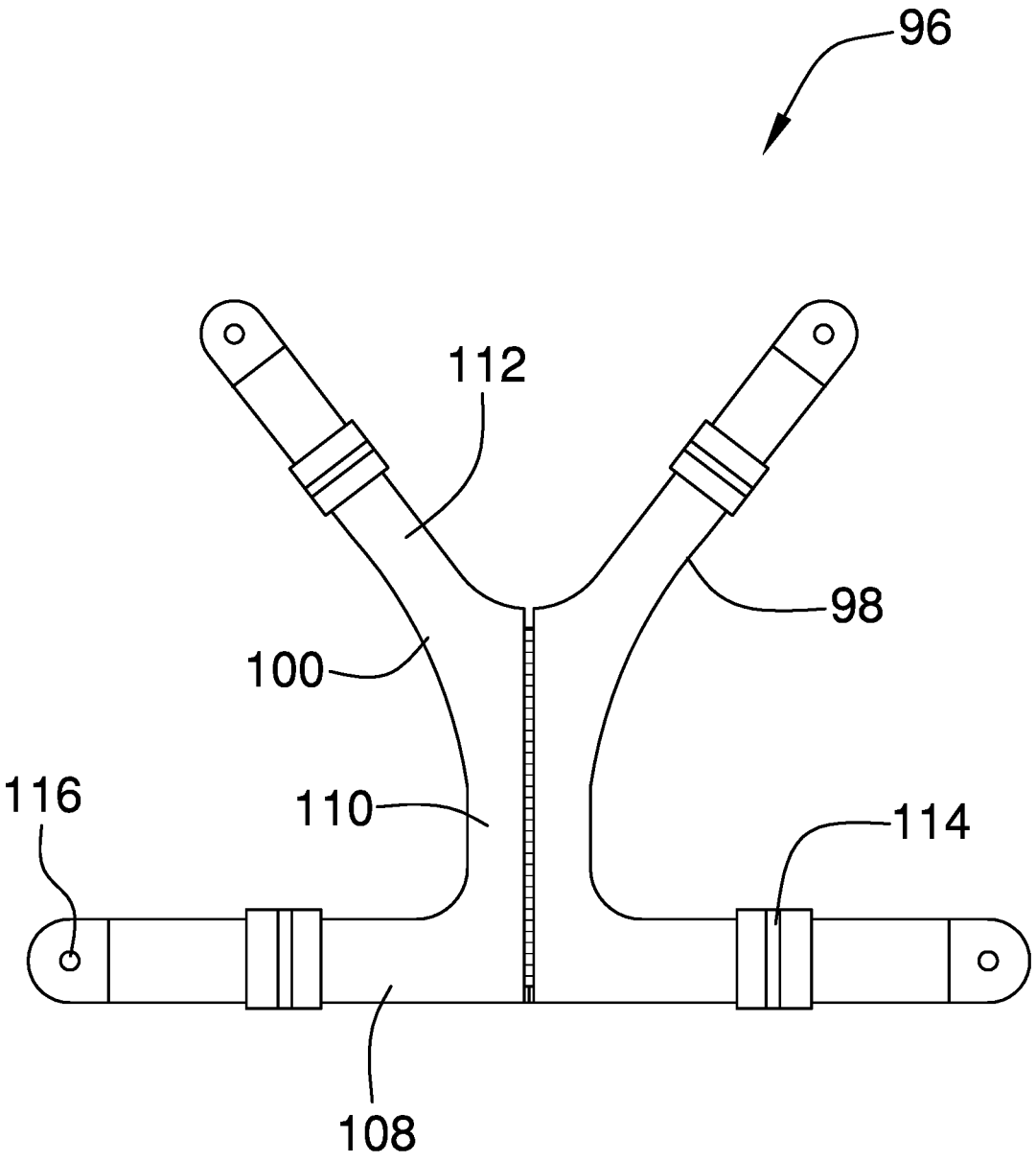
FIG. 4 is a detail view of an embodiment of the disclosure.
Figure 5:
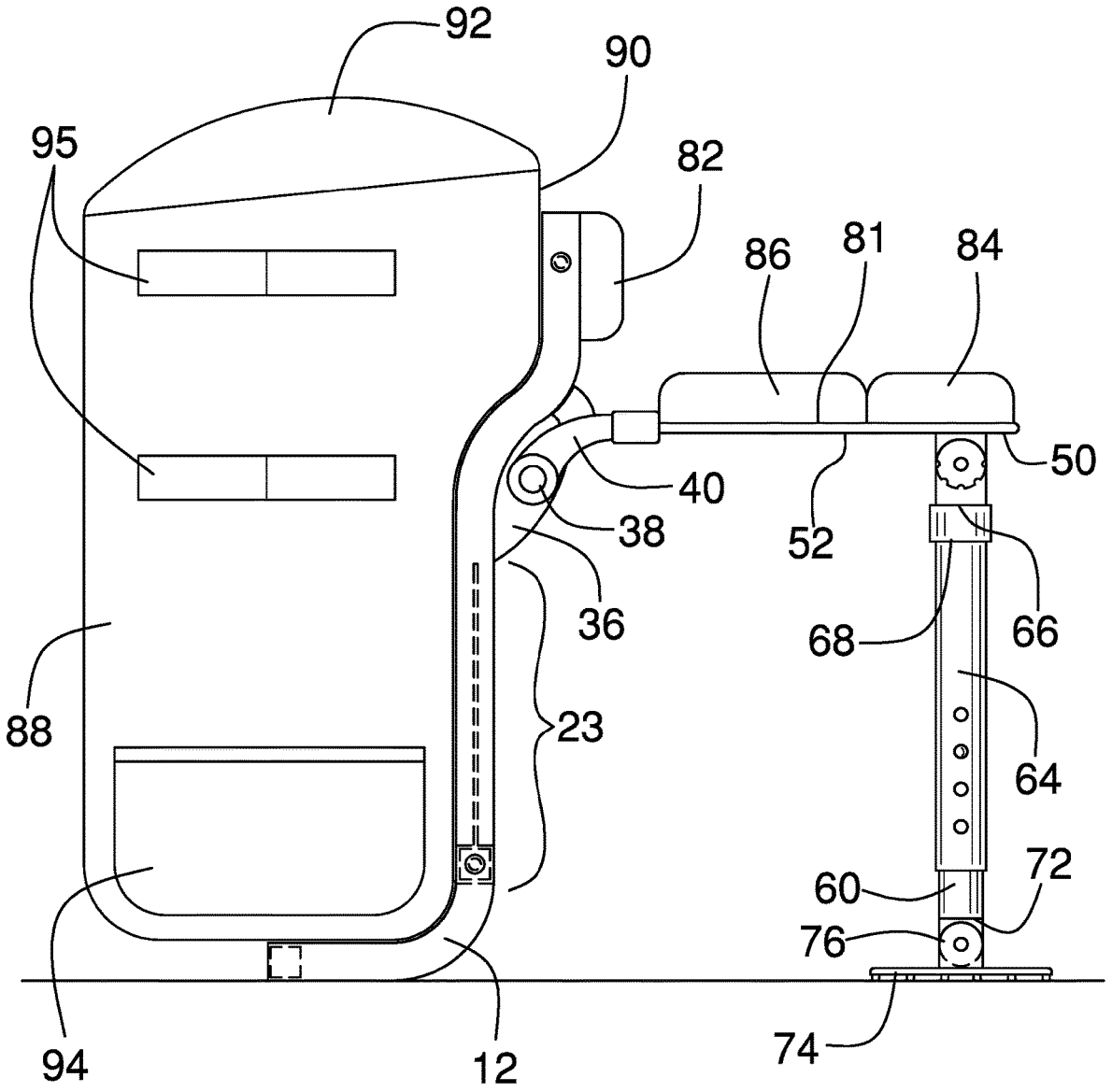
FIG. 5 is a side elevation view of an embodiment of the disclosure.
Figure 6:
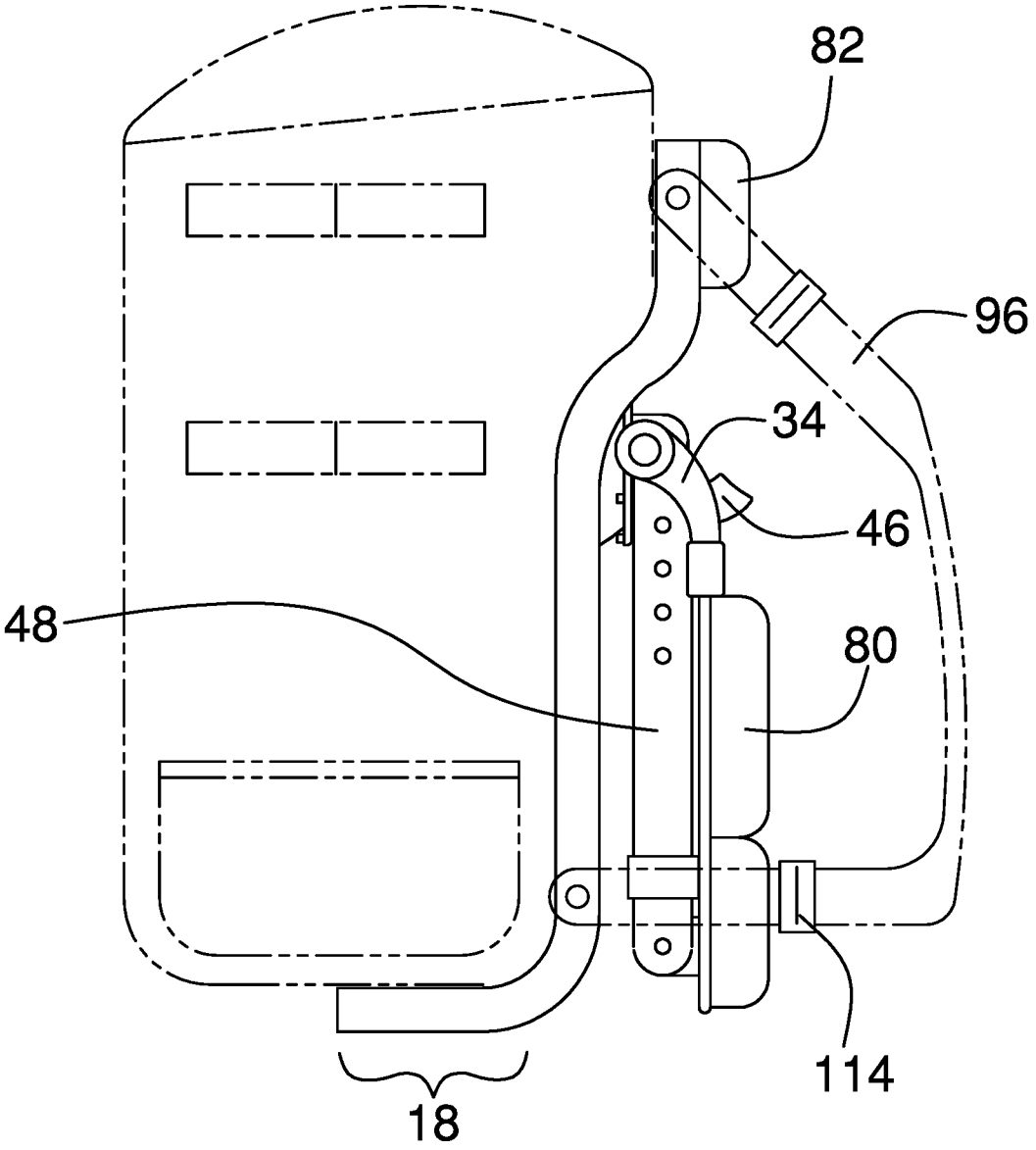
FIG. 6 is a side elevation view of an embodiment of the disclosure.

With reference now to the drawings, and in particular to FIGS. 1 through 6 thereof, a new backpack embodying the principles and concepts of an embodiment of the disclosure and generally designated by the reference numeral 10 will be described.

As best illustrated in FIGS. 1 through 6, the folding chair framed backpack 10 generally comprises a main frame 12 comprising a pair of curved frame posts 14 and a plurality of cross supports 16 extending therebetween. The main frame 12 has a horizontal bottom section 18, a vertical rise section 20 perpendicularly extending from the bottom section 18, and a top section 22 extending from the rise section 20. The top section 22 extends away from the vertical rise section 20 before returning to vertical and thus defines a recessed area 23 adjacent the vertical rise section 20 and below the top section 22. The top section 22 of each of the frame posts angles inwards and is joined by a topmost cross support 24 of the plurality of cross supports to form a trapezoid for increased structural strength, to minimize the profile of the frame, and to create a handle. Each of the frame posts 14 has a pair of harness connection apertures 26 that may be threaded and configured to receive a fastener. A pair of triangular frame supports 28 is coupled between a middle cross support 30 of the plurality of cross supports and each of the pair of frame posts 14 for structural support. Each of the frame supports 14 has a plurality of perforations 32 to reduce weight.

A pair of seat attachments 34 is pivotably coupled to the rise section 20 of the main frame adjacent the top section 22. Each of the pair of seat attachments 34 comprises a flange 36, a rotational hinge 38, and an attachment arm 40. The flange 36 is coupled to an inner face 42 of the frame post within the recessed area 23 where the rise section 20 transitions to the top section 22. The rotational hinge 38 is coupled to the flange 36 and the attachment arm 40 is coupled to the rotational hinge 38. A seat frame 44 is coupled to the attachment arm 40 of each of the pair of seat attachments 34. The seat frame 44 may be a truncated parabola for optimal seating comfort and size maximization. The seat frame 44 has a folded position lying within the recessed area 23 in a plane parallel with a plane of the rise section 20 and an alternate seated position lying in a plane perpendicular with a plane of the rise section 20. A frame brace stop 46 is coupled to the pair of seat attachments 34 to prevent the seat frame 44 from rotating past perpendicular to a plane of the rise section 20.

At least one seat leg 48 is coupled to the seat frame 44. The seat leg 48 is pivotably coupled to a distal end 50 of the seat frame and has a collapsed position folded adjacent a bottom side 52 of the seat frame. The attachment arm 40 is curved and arranged such that the seat frame 44 in the folded position is spaced from the main frame 12 to accommodate the seat leg 48 in the recessed area 23. The seat leg 48 has an alternate extended position lying in a plane perpendicular with the plane of the seat frame 44 in the seated position to maintain the seat frame 44 in the seated position when the main frame 12 is resting on the ground. The seat leg 48 may comprise a telescopable leg shaft 54 having an adjustment mechanism 56. The adjustment mechanism 56 may be a spring-loaded button 58 coupled to an inner portion 60 of the leg shaft that is selectively engageable with a plurality of adjustment apertures 62 extending through an outer portion 64 of the leg shaft. A leg cap 66 is coupled to a top end 68 of the leg shaft and is pivotably coupled to the bottom side 52 of the seat frame. A foot 70 is coupled to a bottom end 72 of the leg shaft. The foot 70 has a rectangular plate 74 and a foot hinge 76 extending from the plate 74. The rectangular plate 74 may have a ridged underside 75 for preventing slippage. The foot hinge 76 is pivotably coupled to the leg shaft 54, which in conjunction with the adjustability of the length of the leg shaft 54 allows for use on uneven terrain.

A plurality of seat cushions 78 is coupled to the seat frame 44 and the main frame 12. The plurality of seat cushions 78 comprises a bottom cushion 80 coupled to a top side 81 of the seat frame and a top cushion 82 coupled to the top section 22 of the main frame. The bottom cushion 80 is a truncated parabola conforming to the shape of the seat frame 44 to cover it entirely. The bottom cushion 80 may comprise a first portion 84 and a second portion 86 to allow for different levels of firmness. The second portion 86 is adjacent the distal end 50 and the first portion 84 extends from the second portion 86 to adjacent the seat attachments 34. The top cushion 82 is trapezoidal to conform to the top section 22 of the main frame. The bottom cushion 80 and the top cushion 82 are coplanar in the folded position and the first portion 84 contacts the user's lower back when carrying the folding chair framed backpack 10.

A backpack 88 is coupled to the main frame 12. The backpack 88 is selectively engageable with the bottom section 18 and the rise section 20 with fasteners such as hook-and-loop or snaps, or may alternatively be sewn directly onto the main frame 12. The backpack 88 has a backside 90 conforming to the shape of the main frame 12 and a rounded top end 92. The backpack 90 has a plurality of pockets 94 and a plurality of hook-and-loop fasteners 95. A harness 96 is coupled to the main frame 12 to carry the folding chair framed backpack 10. The harness 96 is selectively engageable with the pair of harness connection apertures 26 of each of the frame posts 14. The harness 96 comprises a left half 98 and a right half 100. The left half 98 is selectively engageable with a left frame post 102 of the pair of frame posts 14 and the right half 100 is selectively engageable with a right frame post 106 of the pair of frame posts 14. Each of the left half 98 and the right half 100 comprise a horizontal bottom strap 108, a vertical joiner 110, and an angled top strap 112. Each of the bottom strap 108 and the top strap 112 have a strap adjustment mechanism 114 to change the fit of the harness 96. The vertical joiner 110 of each of the left half 98 and the right half 100 may be zippered and selectively engageable. The bottom strap 108 and the top strap 112 each have a reinforced attachment aperture 116. The fastener passes through the attachment aperture 116 to secure the harness to the main frame 12.

In use, the folding chair framed backpack 10 is worn as a backpack and then once a destination is reached is placed on the ground. The seat frame 44 may then be folded out to the seated position and the seat leg is moved to the extended position. The leg shaft 54 is adjusted so that the foot 70 rests firmly on the ground, and the wearer may then sit on the seat cushions 78 like a chair.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A folding chair framed backpack comprising:

a main frame, the main frame comprising a pair of curved frame posts and a plurality of cross supports extending therebetween, the main frame having a horizontal bottom section, a vertical rise section perpendicularly extending from the bottom section, and a top section extending from the rise section, each of the frame posts having a pair of harness connection apertures, the top section extending away from the vertical rise section before returning to vertical, the top section defining a recessed area adjacent the vertical rise section and below the top section;

a pair of seat attachments coupled to the main frame, the pair of seat attachments being coupled to the rise section adjacent the top section;

a seat frame coupled to the pair of seat attachments such that the pair of seat attachments pivotally couple the seat frame to the main frame, the seat frame having a folded position lying in a plane parallel with a plane of the rise section and an alternate seated position lying in a plane perpendicular with a plane of the rise section, the seat frame in the folded position resting within the recessed area such that the bottom cushion and the top cushion are coplanar;

at least one seat leg coupled to the seat frame, the seat leg being pivotably coupled to a distal end of the seat frame, the seat leg having a collapsed position folded adjacent a bottom side of the seat frame and an alternate extended position lying in a plane perpendicular with the plane of the seat frame in the seated position, the seat leg in the extended position maintaining the seat frame in the seated position when the main frame is resting on the ground;

a plurality of seat cushions coupled to the seat frame and the main frame, the plurality of seat cushions comprising a bottom cushion coupled to a top side of the seat frame and a top cushion coupled to the top section of the main frame;

a backpack coupled to the main frame, the backpack being selectively engageable with the bottom section and the rise section; and a harness coupled to the main frame, the harness being selectively engageable with the pair of harness connection apertures of each of the frame posts.

2. The folding chair framed backpack of claim 1 wherein each of the pair of seat attachments comprises:

a flange coupled to the main frame, the flange being coupled to an inner face of the frame post where the rise section transitions to the top section;

a rotational hinge coupled to the flange; and an attachment arm coupled to the rotational hinge.

3. The folding chair framed backpack of claim 1 wherein each of the pair of seat attachments comprises:

a flange coupled to the main frame, the flange being coupled to an inner face of the frame post within the recessed area where the rise section transitions to the top section;

a rotational hinge coupled to the flange; and an attachment arm coupled to the rotational hinge, the attachment arm being curved and arranged such that the seat frame in the folded position is spaced from the main frame to accommodate the seat leg.

4. The folding chair framed backpack of claim 1 further comprising the seat frame and the bottom cushion being truncated parabolas.

5. The folding chair framed backpack of claim 1 further comprising the top section of each of the frame posts angling inwards and being joined by a topmost cross support of the plurality of cross supports to form a trapezoid, the top cushion being trapezoidal.

6. The folding chair framed backpack of claim 1 wherein the seat leg comprises:

a leg shaft, the leg shaft being telescopable and having an adjustment mechanism;

a leg cap coupled to a top end of the leg shaft, the leg cap being pivotably coupled to the bottom side of the seat frame; and a foot coupled to a bottom end of the leg shaft.

7. The folding chair framed backpack of claim 6 wherein the foot has a rectangular plate and a foot hinge extending from the plate, the foot hinge being pivotably coupled to the leg shaft.

8. The folding chair framed backpack of claim 6 wherein the adjustment mechanism is a spring-loaded button coupled to an inner portion of the leg shaft, the button being selectively engageable with a plurality of adjustment apertures extending through an outer portion of the leg shaft.

9. The folding chair framed backpack of claim 1 wherein the bottom cushion comprises a first portion and a second portion, the second portion adjacent the distal end and the first portion extending from the second portion to adjacent the seat attachments.

10. The folding chair framed backpack of claim 1 further comprising a frame brace stop coupled to the pair of seat attachments, the frame brace stop preventing the seat frame from rotating past perpendicular to a plane of the rise section.

11. The folding chair framed backpack of claim 1 further comprising a pair of triangular frame supports coupled between a middle cross support of the plurality of cross supports and each of the pair of frame posts, each of the frame supports having a plurality of perforations to reduce weight.

12. The folding chair framed backpack of claim 1 further comprising the harness comprising a left half and a right half, the left half being selectively engageable with a left frame post of the pair of frame posts and the right half being selectively engageable with a right frame post of the pair of frame posts, each of the left half and the right half comprising a horizontal bottom strap, a vertical joiner, and an angled top strap, the vertical joiner of each of the left half and the right half being selectively engageable, the bottom strap and the top strap each having a reinforced attachment aperture.

13. The folding chair framed backpack of claim 12 further comprising the vertical joiner of each of the left half and the right half being zippered.

14. The folding chair framed backpack of claim 12 further comprising each of the bottom strap and the top strap having a strap adjustment mechanism.

15. The folding chair framed backpack of claim 12 further comprising each of the harness connection apertures being threaded and configured to receive a fastener, the fastener passing through the attachment aperture to secure the harness to the main frame.

16. The folding chair framed backpack of claim 1 further comprising the backpack having a backside conforming to the shape of the main frame and a rounded top end.

17. The folding chair framed backpack of claim 16 further comprising the backpack having a plurality of pockets and a plurality of hook-and-loop fasteners.

18. A folding chair framed backpack comprising:

a main frame, the main frame comprising a pair of curved frame posts and a plurality of cross supports extending therebetween, the main frame having a horizontal bottom section, a vertical rise section perpendicularly extending from the bottom section, and a top section extending from the rise section, the top section extending away from the vertical rise section before returning to vertical, the top section of each of the frame posts angling inwards and being joined by a topmost cross support of the plurality of cross supports to form a trapezoid, the top section defining a recessed area adjacent the vertical rise section and below the top section, each of the frame posts having a pair of harness connection apertures, each of the harness connection apertures being threaded and configured to receive a fastener;

a pair of triangular frame supports coupled between a middle cross support of the plurality of cross supports and each of the pair of frame posts, each of the frame supports having a plurality of perforations to reduce weight;

a pair of seat attachments coupled to the main frame, the pair of seat attachments being coupled to the rise section adjacent the top section, each of the pair of seat attachments comprising:

a flange coupled to the main frame, the flange being coupled to an inner face of the frame post within the recessed area where the rise section transitions to the top section;

a rotational hinge coupled to the flange; and an attachment arm coupled to the rotational hinge;

a seat frame coupled to the attachment arm of each of the pair of seat attachments such that the pair of seat attachments pivotally couple the seat frame to the main frame, the seat frame being a truncated parabola, the seat frame having a folded position lying within the recessed area in a plane parallel with a plane of the rise section and an alternate seated position lying in a plane perpendicular with a plane of the rise section;

a frame brace stop coupled to the pair of seat attachments, the frame brace stop preventing the seat frame from rotating past perpendicular to a plane of the rise section;

at least one seat leg coupled to the seat frame, the seat leg being pivotably coupled to a distal end of the seat frame, the seat leg having a collapsed position folded adjacent a bottom side of the seat frame and an alternate extended position lying in a plane perpendicular with the plane of the seat frame in the seated position, the attachment arm being curved and arranged such that the seat frame in the folded position is spaced from the main frame to accommodate the seat leg, the seat leg in the extended position maintaining the seat frame in the seated position when the main frame is resting on the ground, the seat leg comprising:

a leg shaft, the leg shaft being telescopable and having an adjustment mechanism, the adjustment mechanism being a spring-loaded button coupled to an inner portion of the leg shaft, the button being selectively engageable with a plurality of adjustment apertures extending through an outer portion of the leg shaft;

a leg cap coupled to a top end of the leg shaft, the leg cap being pivotably coupled to the bottom side of the seat frame; and a foot coupled to a bottom end of the leg shaft, the foot having a rectangular plate and a foot hinge extending from the plate, the foot hinge being pivotably coupled to the leg shaft;

a plurality of seat cushions coupled to the seat frame and the main frame, the plurality of seat cushions comprising a bottom cushion coupled to a top side of the seat frame and a top cushion coupled to the top section of the main frame, the bottom cushion being a truncated parabola conforming to the shape of the seat frame, the bottom cushion comprising a first portion and a second portion, the second portion adjacent the distal end and the first portion extending from the second portion to adjacent the seat attachments, the top cushion being trapezoidal to conform to the top section of the main frame, the bottom cushion and the top cushion being coplanar in the folded position;

a backpack coupled to the main frame, the backpack being selectively engageable with the bottom section and the rise section, the backpack having a backside conforming to the shape of the main frame and a rounded top end, the backpack having a plurality of pockets and a plurality of hook-and-loop fasteners; and a harness coupled to the main frame, the harness being selectively engageable with the pair of harness connection apertures of each of the frame posts, the harness comprising a left half and a right half, the left half being selectively engageable with a left frame post of the pair of frame posts and the right half being selectively engageable with a right frame post of the pair of frame posts, each of the left half and the right half comprising a horizontal bottom strap, a vertical joiner, and an angled top strap, each of the bottom strap and the top strap having a strap adjustment mechanism, the vertical joiner of each of the left half and the right half being zippered and selectively engageable, the bottom strap and the top strap each having a reinforced attachment aperture, the fastener passing through the attachment aperture to secure the harness to the main frame.

* * * * *